US007909110B2

(12) United States Patent
Sharma et al.

(10) Patent No.: US 7,909,110 B2
(45) Date of Patent: Mar. 22, 2011

(54) ANCHORING AND SEALING SYSTEM FOR CASED HOLE WELLS

(75) Inventors: Ashish Sharma, Sugar Land, TX (US); Nitin Y. Vaidya, Missouri City, TX (US); Manuel Marya, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 392 days.

(21) Appl. No.: 11/943,516

(22) Filed: Nov. 20, 2007

(65) Prior Publication Data

US 2009/0126945 A1 May 21, 2009

(51) Int. Cl.
*E21B 43/04* (2006.01)

(52) U.S. Cl. ..... 166/387; 166/180

(58) Field of Classification Search ..... 166/387, 166/179, 180, 120; 277/336–340
See application file for complete search history.

(56) References Cited

U.S. PATENT DOCUMENTS

| | | | | |
|---|---|---|---|---|
| 2,712,854 | A * | 7/1955 | Creighton | 166/242.7 |
| 4,499,947 | A * | 2/1985 | Zsoka et al. | 166/179 |
| 5,743,333 | A | 4/1998 | Willauer et al. | |
| 6,827,150 | B2 | 12/2004 | Luke | |
| 6,959,759 | B2 | 11/2005 | Doane et al. | |
| 7,021,390 | B2 * | 4/2006 | Cook et al. | 166/384 |
| 7,040,402 | B2 | 5/2006 | Vercaemer | |
| 7,168,497 | B2 | 1/2007 | Metcalfe et al. | |
| 7,198,110 | B2 | 4/2007 | Kilgore et al. | |
| 7,231,972 | B2 | 6/2007 | Gambier et al. | |
| 7,255,178 | B2 | 8/2007 | Slup et al. | |
| 7,270,177 | B2 | 9/2007 | Vercaemer | |
| 2003/0047322 | A1 * | 3/2003 | Maguire et al. | 166/380 |
| 2005/0155775 | A1 * | 7/2005 | Hirth et al. | 166/387 |
| 2005/0199401 | A1 * | 9/2005 | Patel et al. | 166/387 |

FOREIGN PATENT DOCUMENTS

| | | | |
|---|---|---|---|
| GB | 2423101 | A | 8/2006 |
| WO | 2008060893 | A2 | 5/2008 |

* cited by examiner

*Primary Examiner* — William P Neuder
(74) *Attorney, Agent, or Firm* — Trop, Pruner & Hu, P.C.; Rodney V. Warfford; Kevin B. McGoff

(57) ABSTRACT

An apparatus includes a casing and a sealing element that is retained in the casing. The sealing element has an unset state in which the sealing element has a first radial thickness and a set state in which the sealing element has a second radial thickness that is greater than the first radial thickness to form a seal between the casing and an inner tubular member.

21 Claims, 6 Drawing Sheets

ANCHORING AND SEALING SYSTEM FOR CASED HOLE WELLS

BACKGROUND

The invention generally relates to an anchoring and sealing system for cased hole wells.

A packer is a device that typically is used in a well to form an annular seal between an inner tubing string and a surrounding casing string. More specifically, the packer typically is part of the inner tubing string and contains a sealing element that is formed from one or more elastomer seal rings. The rings are sized to pass through the well when the packer is being run downhole into position, and when the packer is in the appropriate downhole position and is to be set, gages of the packer compress the seal rings to cause the rings to radially expand to form the annular seal. A number of different mechanisms may be used to develop the force to radially expand the seal rings, such as hydraulically, weight set or electrically actuated mechanisms.

Other types of packers may include sealing elements that are set without using a compressive force. For example, a packer may have an inflatable bladder that is radially expanded to form an annular seal using fluid that is communicated into the interior space of the bladder through a control line. As another example, a packer may have a swellable material that swells in the presence of a well fluid or other triggering agent to form an annular seal.

SUMMARY

In an embodiment of the invention, an apparatus includes a casing and a sealing element that is retained in the casing. The sealing element has an unset state in which the sealing element has a first radial thickness and a set state in which the sealing element has a second radial thickness that is greater than the first radial thickness to form a seal between the casing and an inner tubular member.

In another embodiment of the invention, a method that is usable with a well includes providing a sealing element that has an unset state in which the sealing element has a first radial thickness and a set state in which the sealing element has a second radial thickness that is greater than the first radial thickness to form a seal between a casing and an inner tubular member. The method includes retaining the sealing element in the casing.

In yet another embodiment of the invention, a system includes a casing, a sealing element that is retained in the casing and a tubular member that is located inside the casing. The tubular member is adapted to deform against the sealing element to form a seal between the tubular member and the casing.

Advantages and other features of the invention will become apparent from the following drawing, description and claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
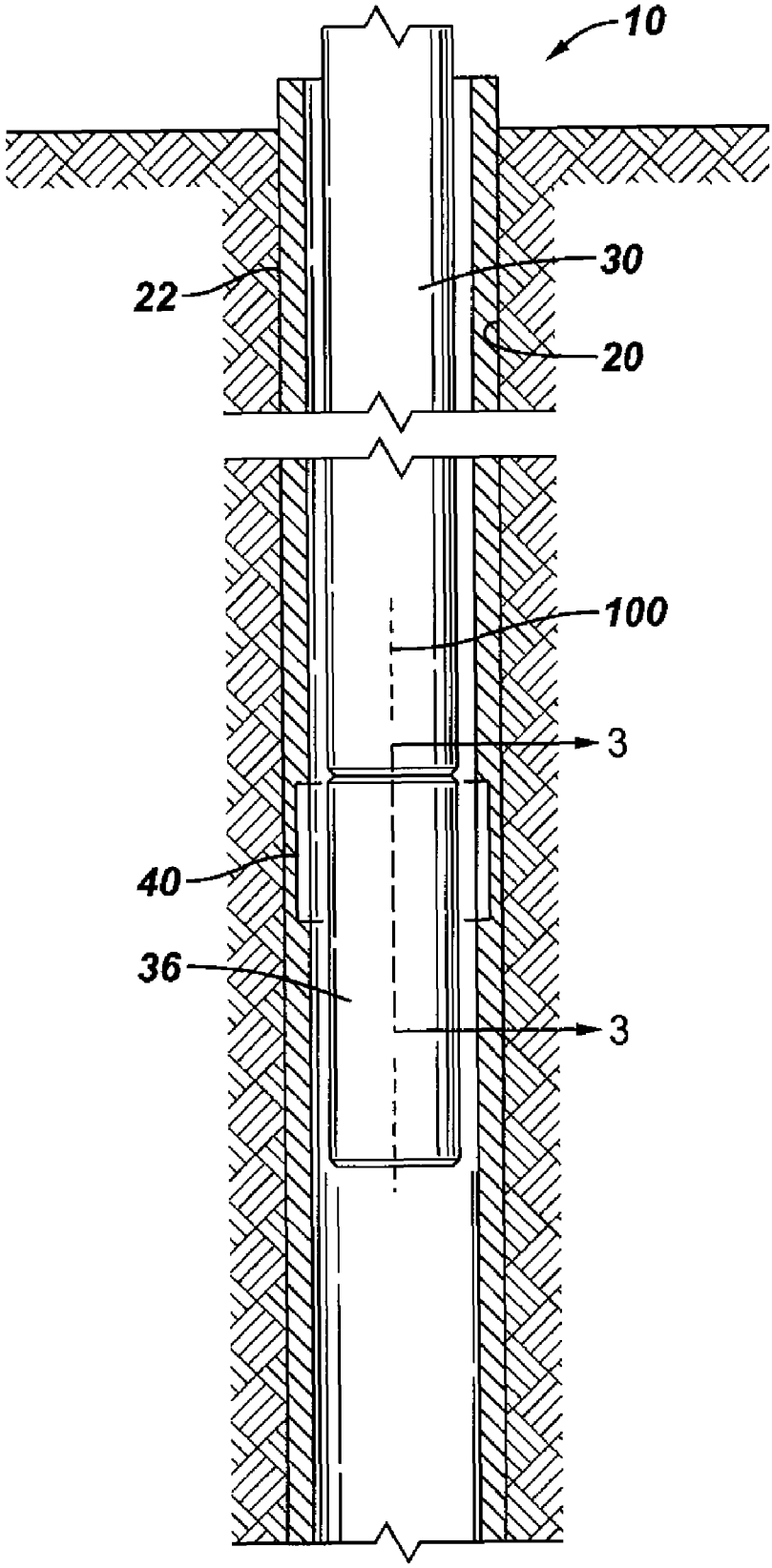
FIGS. 1 and 2 are schematic diagrams of a well showing different states of an anchoring and sealing system according to an embodiment of the invention.
Figure 2:
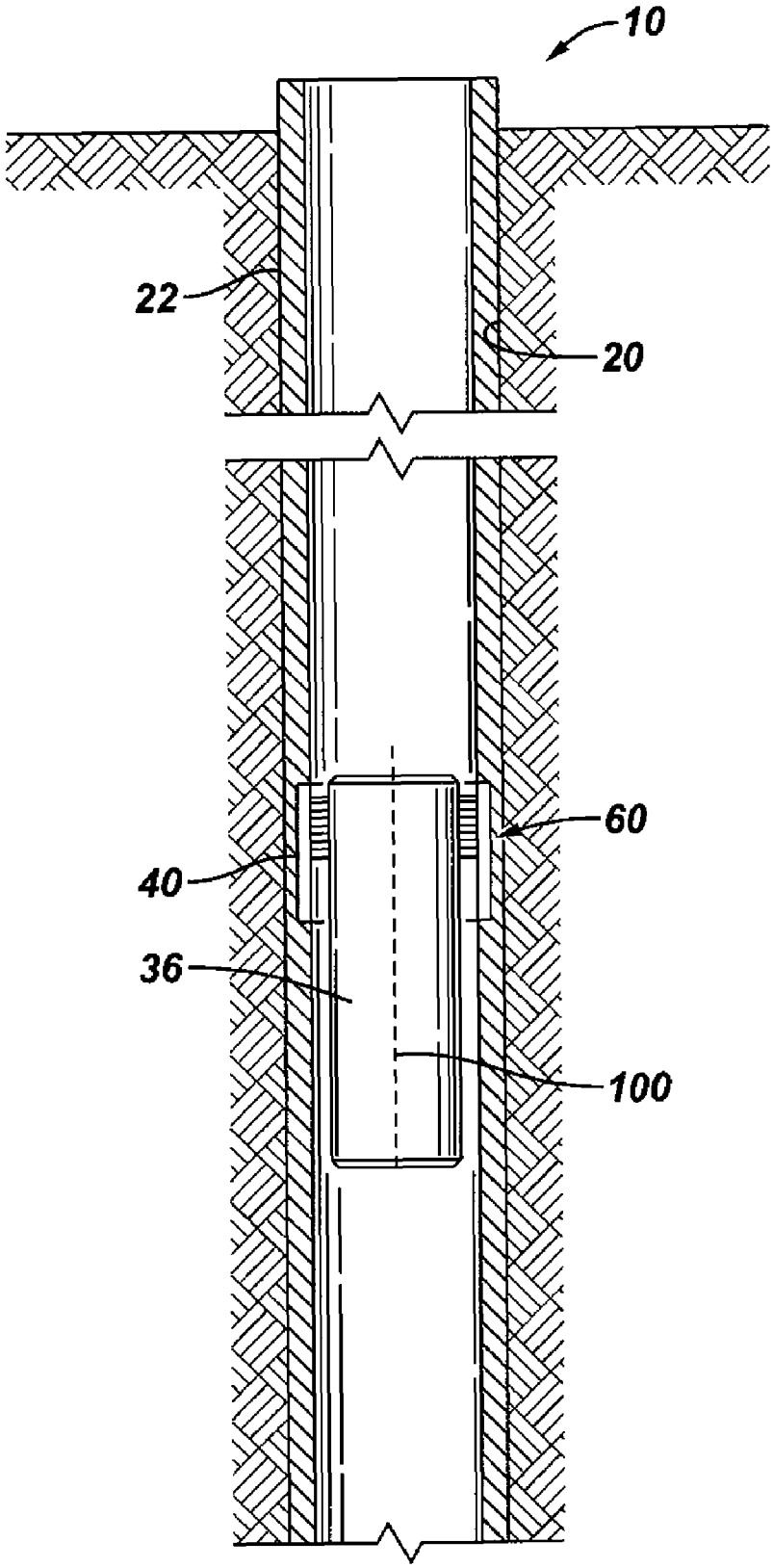

Referring to FIGS. 1 and 2, an embodiment b 10 of a well (a subterranean or subsea well) in accordance with the invention includes a casing string 22 that lines and supports a wellbore 20. Unlike conventional arrangements, the casing string 22 has a built-in anchoring and sealing system 40 for purposes of forming an annular seal (as shown at reference numeral 60 in FIG. 2) between the interior surface of the string 22 and the outer surface of an inner tubular member 36. More specifically, the system 40 has a settable annular sealing element 60 and anchoring features that take the place of a conventional packer. FIG. 1 depicts the system 40 in an unset state, a state in which the annular seal has not been formed. When the system 40 receives an actuating force (as described below), the system 40 radially expands the sealing element 60 to form the annular seal, as depicted in FIG. 2. The inclusion of the sealing and anchoring components in the casing string 22 is to be contrasted to conventional arrangements in which the tubular member 36 may be part of a packer or plug (as examples).

As a more specific example, the tubular member 36 may be part of a tubular string 30 (a work string, production tubing string, test string, etc.), which extends downhole inside the casing string 22. The tubular string 30 may include, as further described below, a setting, or service tool (not shown in FIGS. 1 and 2), which delivers a setting force that the system 40 communicates to the sealing element 60 to cause the element 60 to transition from a first radial thickness to a second thicker radial thickness to form the annular seal, as depicted in FIG. 2.

Among its other features, the system 40 includes a locking mechanism for purposes of maintaining the sealing element in its set state, and the system 40 is also constructed to anchor the seal in place. Thus, dogs, or slips, a conventional component of packers, are not required.

The advantages of a system that includes a casing, which retains and anchors an annular sealing element may include one or more of the following. The design of the sealing element is greatly simplified, as compared to, for example, the design of a packer's sealing element. The design of the setting/service tool is simplified. The pressure and temperature rating of the system 40 may be significantly higher than conventional sealing devices (e.g., packers) due to the presence of both multiple seal surfaces and the capturing of the sealing element in a groove, in specific embodiments that are further described below. Thus, the system 40 may be well-suited for high pressure high temperature (HPHT) applications. As described below, the sealing element may be protected in some embodiments of the invention, as opposed to conventional packer designs where the sealing element is exposed to swabbing/abrasion during the running of the element into place in the well. High strength casing strings (e.g., casing strings for HPHT applications) may be used due to the elimination of the slips, which tend to "bite" into the casing string.

Figure 3:
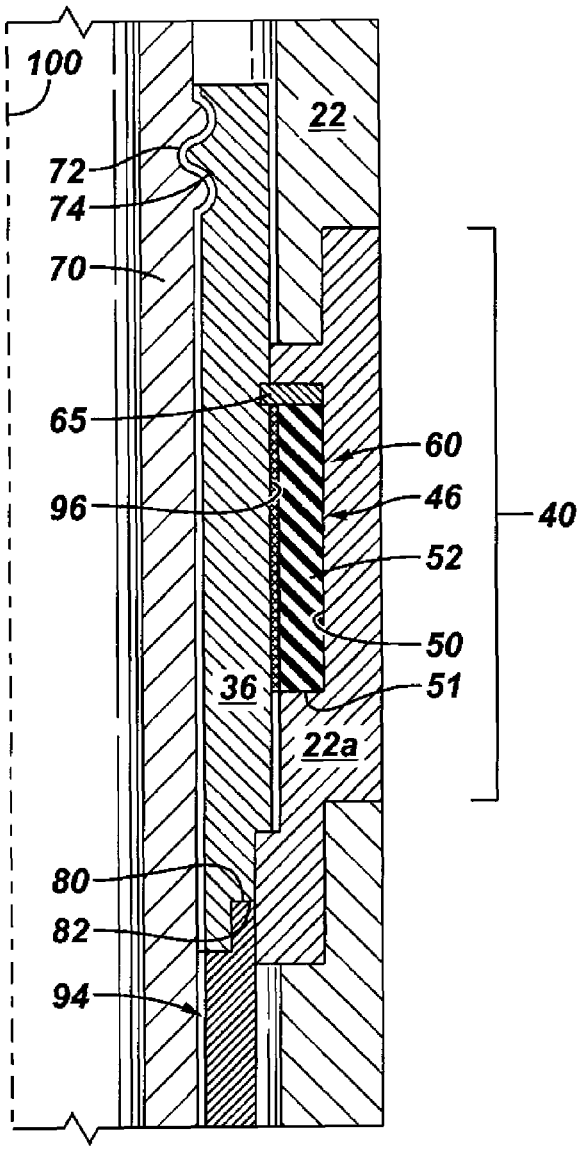
FIG. 3 is a partial cross-sectional diagram taken along line 3-3 of FIG. 1 according to an embodiment of the invention.

As a more specific example, FIG. 3 depicts a partial cross-sectional view of the anchoring and sealing system 40 in accordance with some embodiments of the invention. In particular, FIG. 3 depicts a right-hand cross-sectional view of the system 40 taken about its longitudinal axis 100 and along line 3-3 of FIG. 1. The longitudinal axis 100 is coaxial with the tubular string 30 and the tubular member 36 (see FIGS. 1 and 2) near the system 40. As can be appreciated by one of skill in the art, the true cross-section of the system 40 taken alone line 3-3 of FIG. 1 also includes a mirroring left-hand cross-section on the left-hand side of the longitudinal axis 100, as the system 40 is generally symmetrical about the axis 100.

As depicted in FIG. 3, the system 40 includes an annular sealing element 60 and a section 22*a* of the casing 22, which contains an inner profile 46 that is designed to both retain and anchor the annular sealing element 60 in place. For the embodiment that is depicted in FIG. 3, the inner profile 46 includes an annular slot 50, which is formed in the inner surface of the casing section 22*a* and retains the annular sealing element 60. At the bottom of the slot 50, the casing section 22*a* contains a "no go" shoulder 51, which provides a longitudinal stop for purposes of setting the sealing element 60. In this regard, when the system 40 receives a setting force from a service/setting tool 70 to expand the sealing element 60, the force is communicated to a setting ring 65 that is located in the slot 50, secured to the tubular member 36, and is disposed at the top of the sealing element 60.

More specifically, when the sealing element 60 is set, a downward axial force is applied to the setting ring 65, which causes the ring 65 to move in a downward direction and communicate a corresponding compression force across the sealing element 60 to thereby cause the element's radial expansion. In its fully radially expanded state (i.e., in its set state), the sealing element 60 forms the annular seal between the interior surface of the casing 22 and an exterior surface 96 of the inner tubular member 36.

As examples, the inner tubular member 36 may be a mandrel, or sleeve, that is connected to a lower completion 94. As a more specific example, the lower completion 94 may be a circulation valve, although other tools and/or lower completions are contemplated in other embodiments of the invention. During the expansion of the sealing element 60, the tubular member 36 moves downwardly, a movement that may be used to actuate a tool of the lower completion 94 (to open a circulation valve, for example).

The downward axial force that is used to set the sealing element 60 is derived from, as an example, a collet sleeve 72 of the service/setting tool 70 in accordance with some embodiments of the invention. More particularly, as further described below, the collet sleeve 72 engages a profile 74 of the tubular member 36 to exert a downward force on the setting ring 65 for purposes of radially expanding the sealing element 60.

As also depicted in FIG. 3, in accordance with some embodiments of the invention, the casing section 22*a* includes a lower inner annular shoulder 80, which forms a "no go" shoulder for purposes of engaging a corresponding outer shoulder 82 of the tubular member 36 to limit the member's downward travel. Additionally, as further described below, a ratchet mechanism (not shown in FIG. 3) locks the axial position of the setting ring 65 to maintain the sealing element 60 in its set state.

Among its other features, in accordance with some embodiments of the invention, the system 40 includes a protective covering 51, which may, as depicted in FIG. 3 be disposed on and protect the inner surface of the sealing element 60. The protective covering 51 temporarily protects the sealing element 60 from operations that occur inside the casing string 22, such as cementing operations, for example. More specifically, the protective covering 51 may protect the sealing element 60 from swabbing, abrasion or any other downhole operation that may damage the sealing element 60. The protective covering 51 may be temporary in nature and may be made from a dissolvable/frangible material or any other material that is reactive or starts communicating fluid over a period of time. For embodiments of the invention in which the sealing element 60 is made from a swellable material, the protective covering 51 may be permeable or porous material or any other material that gradually absorbs fluid from the surrounding environment.

Depending on the particular embodiment of the invention, the sealing element 60 may include a sealing material 52, such as any of the following: rubber, including swellable and wire reinforced rubber; polymers, thermoplastics (Teflon®, for example); thermosets (epoxies, for example); metals; alloys (deformable, elastic and plastic); alloy composites and non-metals (graphite, expanded graphite, etc.), as just a few examples. The sealing element 60 produces any type or combination of types of sealing, such as rubber-to-rubber, rubber-to-metal, metal-to-metal, rubber-to-non-metal, non-metal-to-non-metal seals, etc.

Although not depicted in FIG. 3, the casing 22 may include one or more expansion joints to compensate for thermal expansion or tubing movement for purposes of more efficiently aligning the service tool to the setting ring 65.

Figure 4:
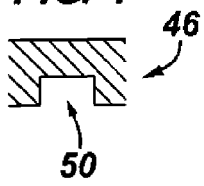
FIGS. 4, 5, 6, 7, 8 and 9 are illustrations of different profiles on the inside of the casing string according to different embodiments of the invention.
Figure 5:
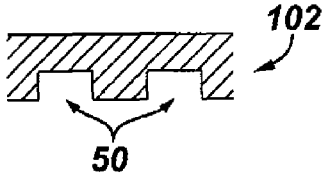

The inner profile 46 of the casing section 22*a* may take on a number of different forms, depending on the particular embodiment of the invention. For example, FIGS. 3 and 4 (a cross-sectional view) depicts the profile 46 as containing the single annular groove 50. However, in accordance with other embodiments of the invention, the system 40 may include multiple grooves, which each groove housing a corresponding sealing element and setting ring. For example, FIG. 5 depicts another profile 102, which includes multiple grooves 50.

Figure 6:
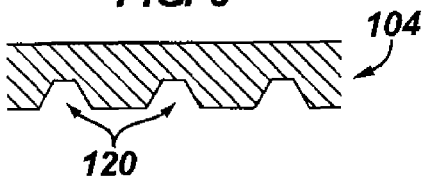
Figure 7:
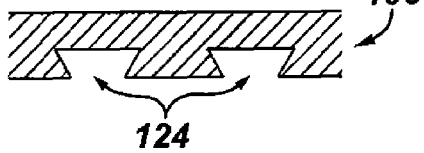
Figure 8:
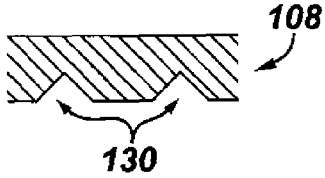
Figure 9:
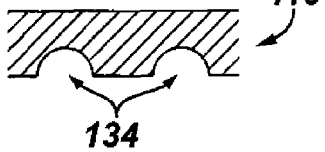

The grooves 50 may have cross-sections other than square cross-sections in accordance with other embodiments of the invention. In this regard, FIG. 6 depicts an alternative profile 104, which includes multiple grooves 120, that have beveled surfaces. FIG. 7 depicts an alternative in an alternative profile 106 that includes dovetail-shaped grooves 124. As yet other variations, FIG. 8 depicts an alternative profile 108 that includes grooves 130 that have triangular cross-sections; and FIG. 9 depicts an alternative profile 110 that includes grooves 134 that have rounded grooves 134. Thus, many variations are contemplated and are within the scope of the appended claims.

Figure 10:
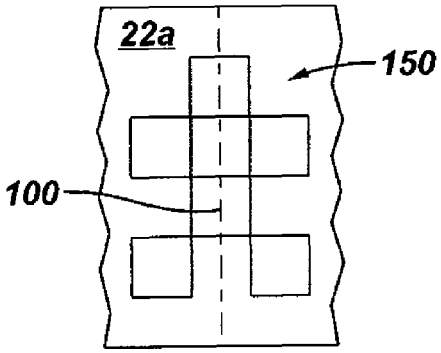
FIGS. 10, 11 and 12 are views of casing strings sections illustrating slot patterns on the inside of the casing string according to different embodiments of the invention.
Figure 11:
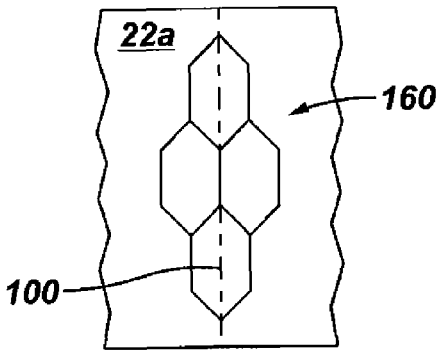
Figure 12:
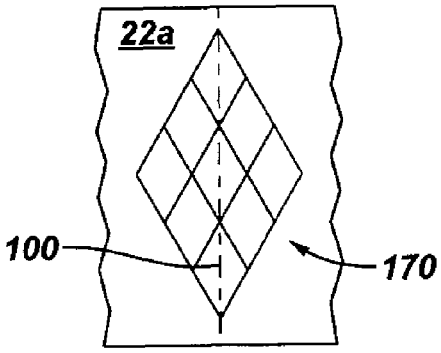

In other embodiments of the invention, the above-described grooves may be replaced by recessed regions that do not individually extend completely around the longitudinal axis 100 in the inner surface of the casing string 22. Each region may contain a sealing element and setting ring, for example. More specifically, FIG. 10 depicts an arrangement in accordance with some embodiments of the invention in which the inner surface of the casing string section 22*a* includes square recesses 150 that are arranged in a particular pattern around the longitudinal axis 100. As another variation, FIG. 11 depicts a pattern 160 of pentagon-shaped slots in the casing section 22*a*. As yet another variation, FIG. 12 depicts a pattern 170 of triangular-shaped slots in a diamond pattern. Thus, many variations are possible and are within the scope of the appended claims.

Figure 13:
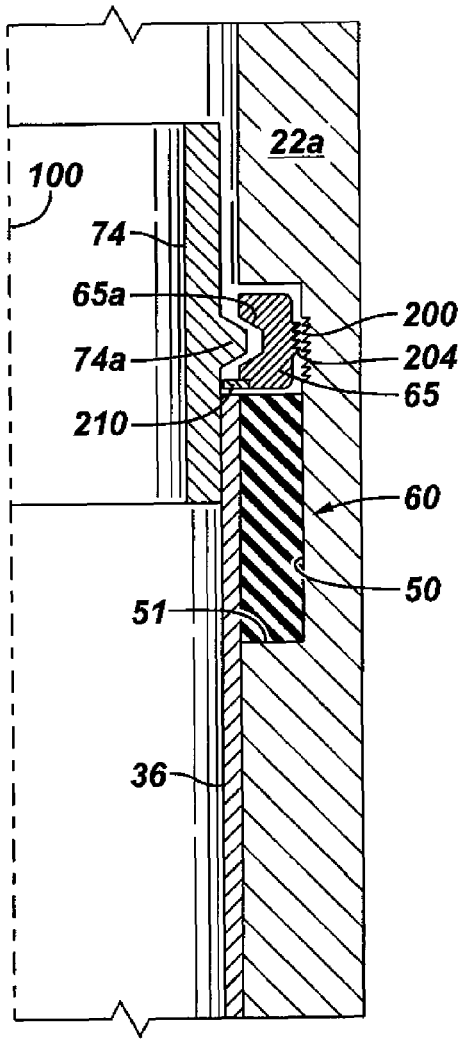
FIGS. 13, 14 and 15 are partial cross-sectional views of other compression-type anchoring and sealing systems according to other embodiments of the invention.

FIG. 13 depicts a partial cross-sectional view of the anchoring and sealing system 40 and an associated service tool that is used to set the sealing element 60 in accordance with some embodiments of the invention. More specifically, for this example, the casing section 22*a* includes the annular groove 50, which contains the setting ring 65 and the sealing element 60. As shown in FIG. 13, the setting ring 65 includes ratchet teeth 204 that engage corresponding ratchet teeth 200 that are formed on the interior surface of the casing section 22*a* inside the slot 50. Thus, the axial position of the setting ring 65 is maintained due to this ratchet mechanism.

For this example, the collet sleeve 74 of the service tool includes a radial extension 74*a* that extends in a radially outward direction to mate with a corresponding annular groove 65*a* of the setting ring 65. When these two components engage, downward movement of the collet sleeve 74 causes corresponding downward movement of the setting ring 65 to set the sealing element 60. As depicted in FIG. 13, the mandrel or sleeve 90 is connected to the collet sleeve 74 for purposes of actuating a downhole tool.

Figure 14:
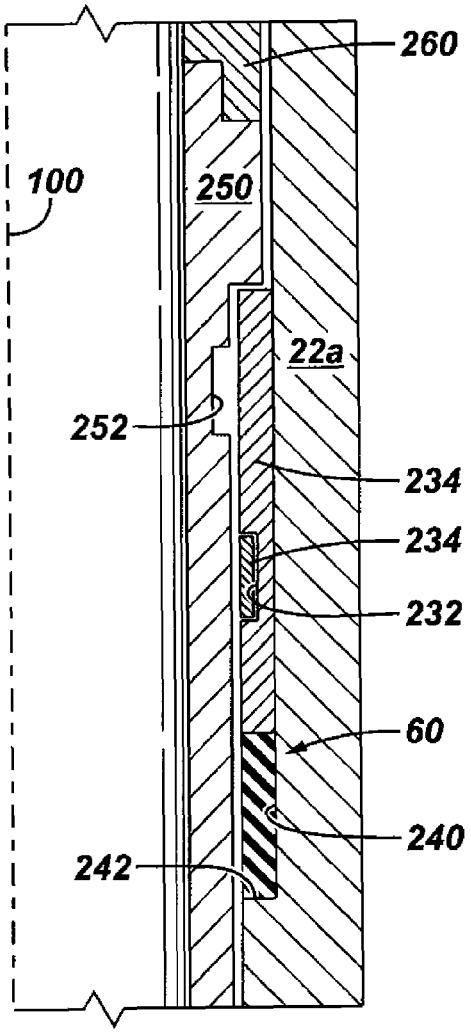

As another variation, FIG. 14 depicts a partial cross-sectional view of the system 40 and a service/setting tool 260 according to another embodiment of the invention. In this arrangement, the casing string section 22*a* includes an annular recessed region 240 that receives the sealing element 60 and a setting ring 230. As shown, the setting ring 230 is radially positioned to act on the sealing element 60 to push the sealing element 60 against a lower "no go," or annular shoulder 242. The setting ring 230 includes an annular groove 232 that receives a split lock ring 234 (such as a C-ring, for example). The service/setting tool 260 engages the top of the setting sleeve 250 and moves it downward. The setting sleeve 250 in turn engages the top of the setting ring 230 and moves it downwards to compress the sealing element 60 at the same time. Sealing element 60 when fully expanded seals against the outer surface of the sleeve 250. At the same time, the split lock ring 234 aligns with a groove on the outer surface of the sleeve 250 and pops open to lock the sleeve 250 with the setting ring 230. A ratchet (not shown in FIG. 14) locks the position of the setting ring 230 and thus, maintains the position of the sealing element 60. The sleeve 250 may be connected to a lower completion, in accordance with some embodiments of the invention.

Figure 15:
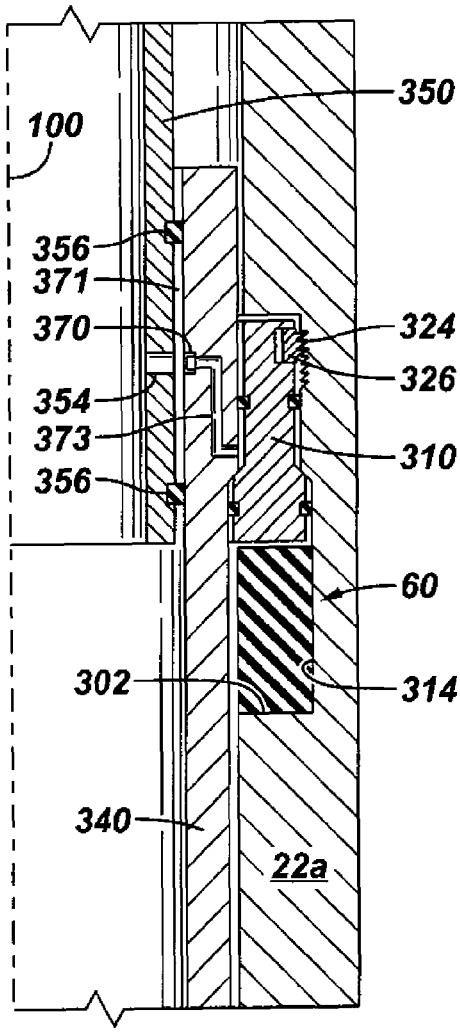

FIG. 15 depicts a partial cross-sectional view of the system 40 and service tool in accordance with yet another embodiment of the invention. In this arrangement, the sealing element 60 resides inside an annularly recessed region 314 of the casing section 22*a*. Downward movement of the sealing element 60 is limited by a "no go," or lower, inner annular shoulder 302 of the casing section 22*a*. The compression of the sealing element 60 is provided by a piston 310, that has a position that is lockable by a ratchet mechanism 324 and 326.

The system also includes a tubular member, such as a sleeve 340, which actuates a lower completion, for example. The sleeve 340 is adjacent to the outer surface of the sealing element 60 and includes a passageway 373 for purposes of establishing fluid communication between the piston 310 and the inner passageway of the casing string 22. In this regard, a plug 370 blocks communication between the interior of the sleeve 340 and the longitudinal passageway 373. When a radial port 354 of a setting sleeve 350 of the service tool is generally aligned with the plug 370, a sealed communication space 371 exists. Fluid communication pressure may then be applied through the tubing string that contains the service tool to exert fluid pressure on the plug 370 for purposes of removing the plug 370. Upon this occurrence, fluid communication is established between the tubing string's central passageway and the piston 310 for purposes of producing a downward force on the piston 310 to set the sealing element 60.

Figure 16:
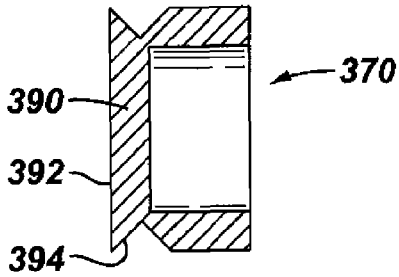
FIG. 16 is a cross-sectional view of an exemplary plug of FIG. 15 according to an embodiment of the invention.

The plug 370 may take on numerous forms, depending on the particular embodiment of the invention. As examples, the plug 370 may be an e-trigger, a shearable plug, a burst disc, etc. As a more specific example, FIG. 16 depicts an embodiment of the plug 370 in accordance with some embodiments of the invention. In this embodiment, the plug includes a sealing surface 392 that forms a barrier between the space 371 (FIG. 15) and the central passageway of the tubing string. The plug 370 is generally formed, such as by way of an annular notch 394, to rupture at a predetermined pressure threshold or shear by a predetermined mechanical force to establish fluid communication to drive the piston 310.

Figure 17:
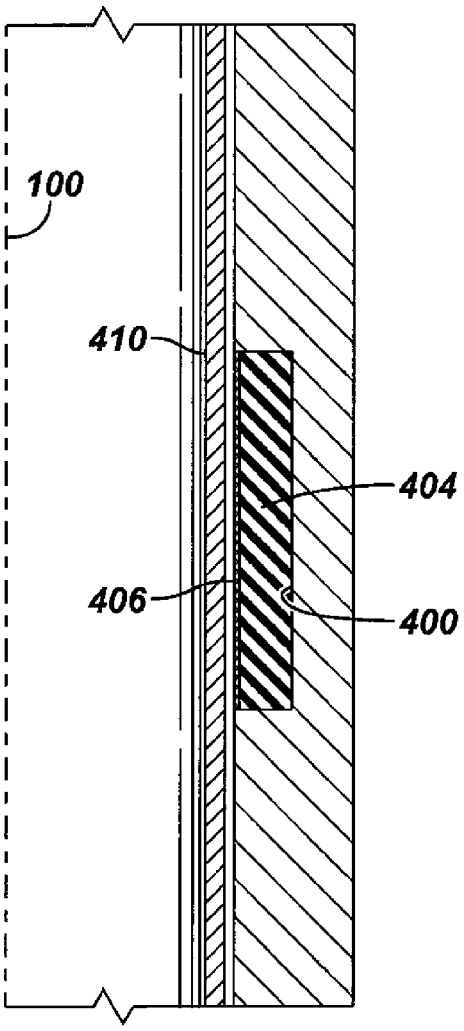
FIGS. 17 and 18 are partial cross-sectional views of an anchoring and sealing system formed from a deformable sleeve according to an embodiment of the invention.
Figure 18:
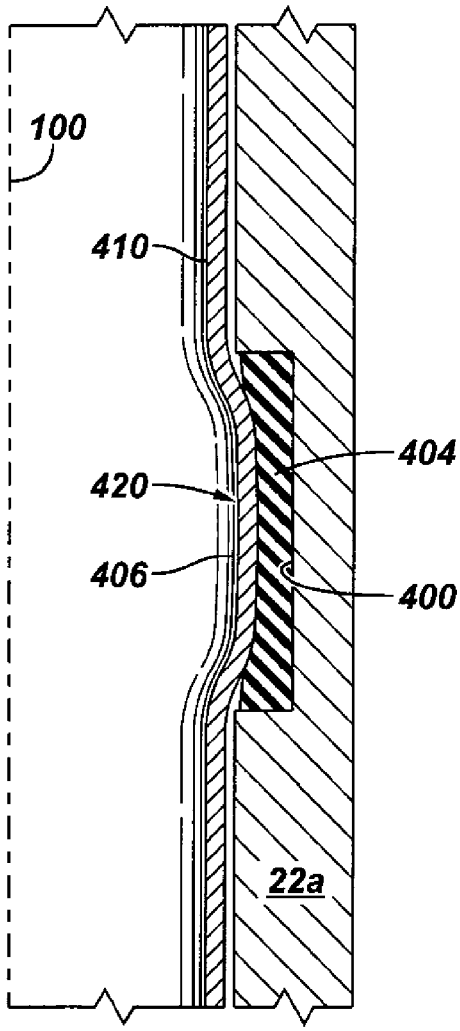

As yet another variation, FIG. 17 depicts an embodiment in which a deformable sleeve 410 is used to form a seal between an annular sealing element 404 that is disposed in an annular groove 400 inside the casing string section 22*a*. In this regard, the sleeve 410 is disposed on the inner surface of the sealing element 404. Referring also to FIG. 18, when a seal is to be formed between the sleeve 410 and the casing section 22*a*, the sleeve 410 is deformed, which causes its radial expansion (as shown in FIG. 18). As examples, the radial force on the sleeve 410 may be exerted by thermal expansion, magnetic fields, heat from a chemical reaction, etc., depending on the particular embodiment of the invention.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus comprising:

a casing to line and support a wellbore; and a sealing element retained in the casing, the sealing element having an unset state in which the sealing element has a first radial thickness and a set state in which sealing element has a second radial thickness greater than the first radial thickness to form a seal between the casing and an inner tubular member, wherein the casing comprises an interior surface profile, and the sealing element is disposed in the interior surface profile.

2. The apparatus of claim 1, wherein the profile comprises a groove in an interior surface of the casing, and the sealing element is disposed in the groove.

3. The apparatus of claim 1, wherein the profile comprises a plurality of grooves in an interior surface of the casing, and the sealing element is disposed in one of the grooves.

4. The apparatus of claim 3, further comprising:

additional sealing elements, said additional sealing elements being disposed in the other grooves and each of said additional sealing elements having an unset state in which the sealing element has a first radial thickness and a set state in which sealing element has a second radial thickness greater than the first radial thickness to form a seal between the casing and the inner tubular member.

5. The apparatus of claim 1, wherein the interior surface profile comprises a plurality of recessed regions in the casing, and the sealing element is disposed in one of the recessed regions.

6. The apparatus of claim 5, wherein the regions comprise slots having square-shaped, pentagon-shaped or triangle-shaped cross-sections.

7. The apparatus of claim 5, further comprising:

additional sealing elements, said additional sealing elements being disposed in the other recessed regions and each of said additional sealing elements having an unset state in which the sealing element has a first radial thickness and a set state in which sealing element has a second radial thickness greater than the first radial thickness to form a seal between the casing and the inner tubular member.

8. The apparatus of claim 1, further comprising:

a setting element to apply a compressive force to transition the sealing element from the unset state to the set state, the setting element being retained in the casing.

9. The apparatus of claim 8, wherein the setting element comprises a ring.

10. The apparatus of claim 8, further comprising:

a ratchet mechanism to secure an axial position of the setting element.

11. The apparatus of claim 8, wherein the setting element is adapted to be engaged by a tool run downhole inside the casing.

12. The apparatus of claim 11, wherein the setting element comprises a lock ring to lock a state of the sealing element.

13. The apparatus of claim 8, wherein the setting element comprises a piston adapted to respond to fluid pressure to compress the sealing element, the piston being retained in the casing.

14. The apparatus of claim 13, wherein the setting element further comprises:

a lock ring to retain an axial position of the piston.

15. The apparatus of claim 8, further comprising:

a mandrel adapted to move in response to movement of the setting element.

16. The apparatus of claim 15, wherein the mandrel is adapted to operate a downhole valve.

17. The apparatus of claim 1, further comprising:

a protection element to protect the sealing element from an operation occurring inside the casing.

18. The apparatus of claim 17, wherein the protection element comprises a dissolvable material, a frangible material or a reactive material.

19. A method usable with a well, comprising:

providing a sealing element having an unset state in which the sealing element has a first radial thickness and a set state in which sealing element has a second radial thickness greater than the first radial thickness to form a seal between a casing and an inner tubular member, the casing being adapted to line and support a wellbore; and retaining the sealing element in the casing, wherein the act of retaining comprises retaining the sealing element in an interior profile of the casing.

20. The method of claim 19, further comprising:

retaining additional sealing elements in the casing, each of said additional sealing elements having an unset state in which the sealing element has a first radial thickness and a set state in which sealing element has a second radial thickness greater than the first radial thickness to form a seal between the casing and the inner tubular member.

21. The method of claim 19, further comprising:

retaining a setting element in the casing to apply a compressive force to transition the sealing element from the unset state to the set state.

* * * * *